United States Patent [19]

Keeling et al.

[11] 4,195,442

[45] Apr. 1, 1980

[54] ADMISSION AND EGRESS CONTROL STRUCTURE

[75] Inventors: Ralph R. Keeling, Richton Park; Michel F. Seranne, Homewood, both of Ill.

[73] Assignee: Illinois Central Gulf Railroad, Chicago, Ill.

[21] Appl. No.: 901,319

[22] Filed: May 1, 1978

[51] Int. Cl.[2] ..... E05B 65/00

[52] U.S. Cl. ..... 49/35; 49/42; 49/49

[58] Field of Search ..... 49/49, 35, 42–46, 49/386, 394; 292/144, 251.5; 109/8, 64; 358/108

[56] References Cited

U.S. PATENT DOCUMENTS

| | | | |
|---|---|---|---|
| 2,984,510 | 5/1961 | Hoffmann | 292/251.5 X |
| 3,169,329 | 2/1965 | Powers | 49/394 X |
| 3,309,664 | 3/1967 | Deutsch et al. | 292/144 X |
| 3,813,836 | 6/1974 | Dielman | 49/386 X |
| 4,063,519 | 12/1977 | Pretini | 49/42 X |

*Primary Examiner*—Kenneth Downey

*Attorney, Agent, or Firm*—Wegner, Stellman, McCord, Wiles & Wood

[57] ABSTRACT

An admission and/or egress control structure for separating two areas and regulating the passage of human traffic between the two areas including a barrier adapted to be disposed between the two areas to be separated, at least one turnstile in the barrier through which unassisted ambulatory humans may easily pass from one area to the other, at least one gate in the barrier extending to the bottom thereof through which nonambulatory and assisted ambulatory humans may easily pass from one area to the other, hinges mounting the gate for movement between open and closed positions relative to the barrier, springs normally and yieldably urging the gate towards the closed position, a lock for normally locking the gate in the closed position, and a control for the lock to unlock the gate from the closed position so that nonambulatory and assisted ambulatory humans may move the gate against the springs to the open position to pass easily therethrough to move from one area to the other without traversing either the barrier or the turnstile.

11 Claims, 7 Drawing Figures

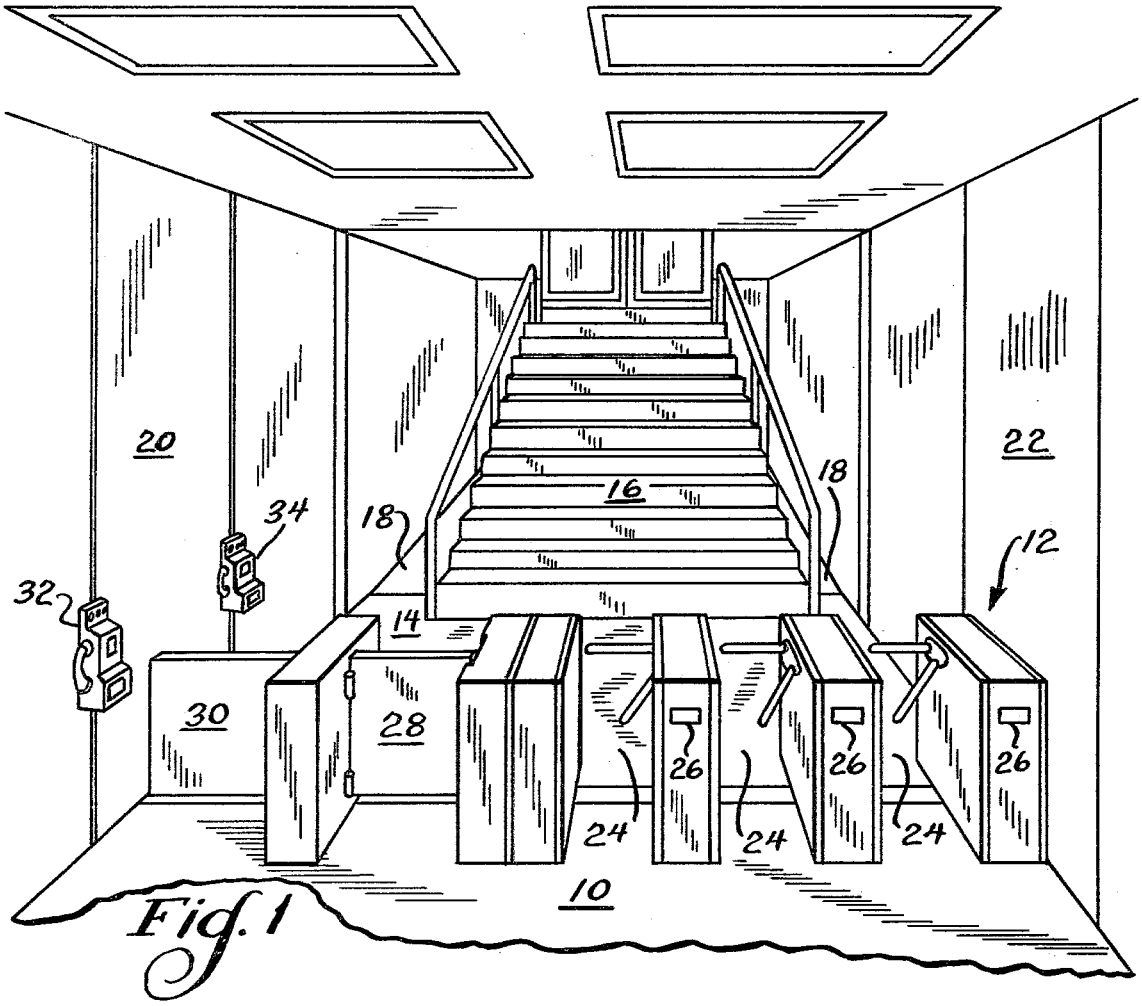
Fig. 1
Fig. 2
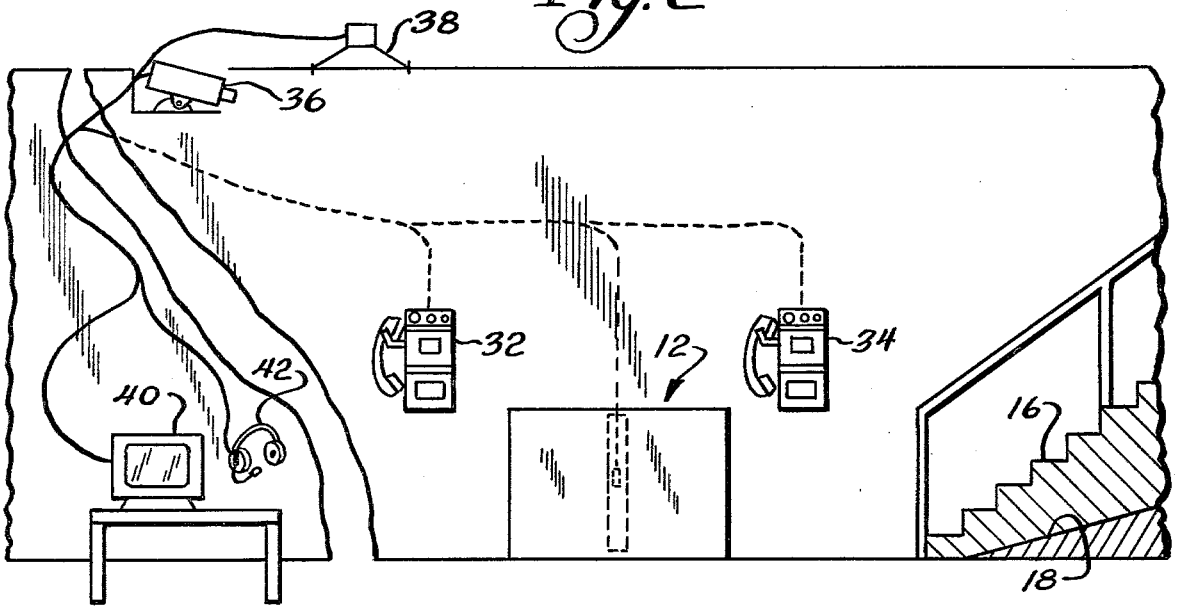

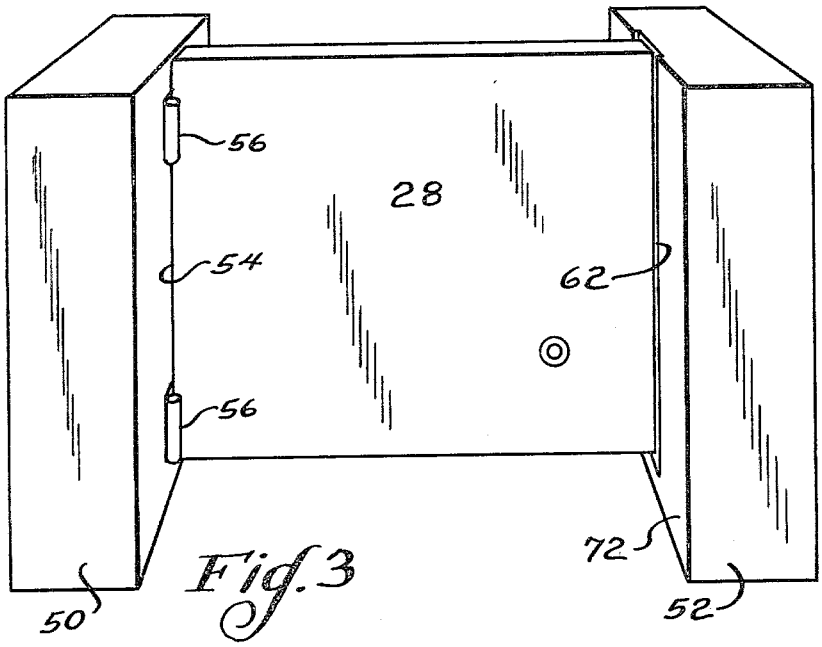
Fig. 3
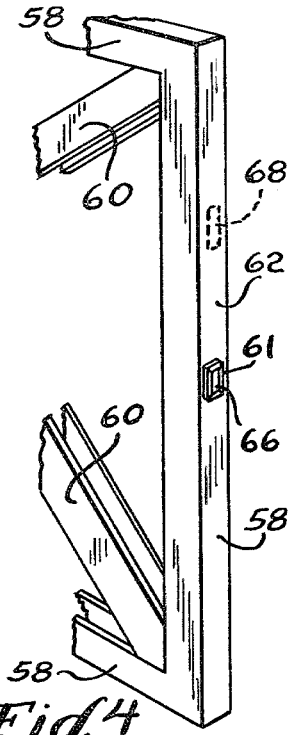
Fig. 4
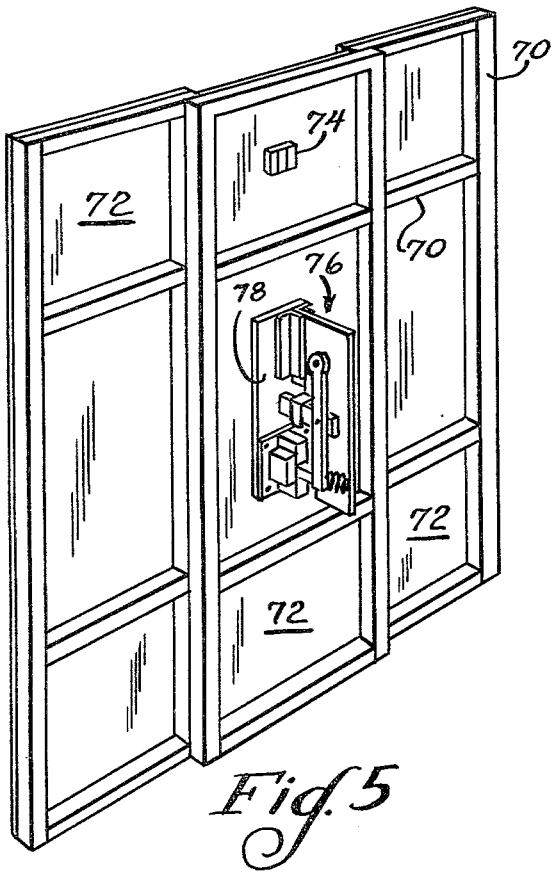
Fig. 5
Fig. 6
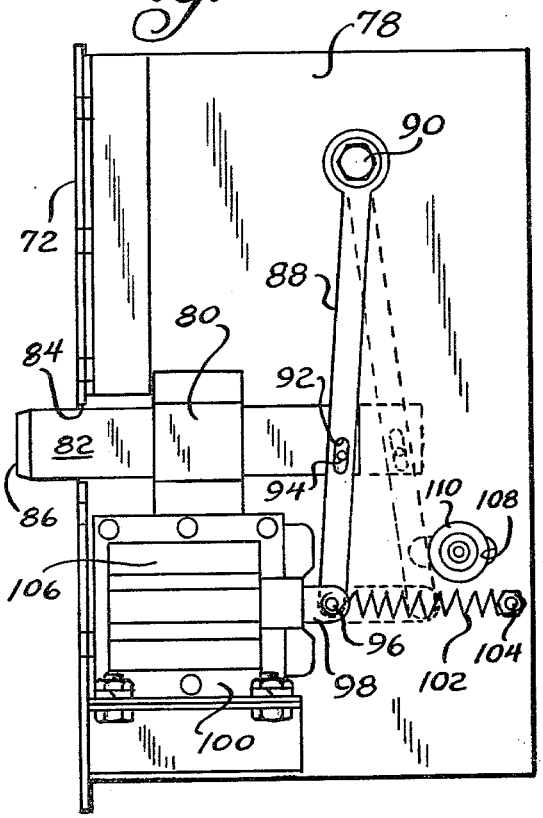

ADMISSION AND EGRESS CONTROL STRUCTURE

BACKGROUND OF THE INVENTION

This invention relates to an admission and/or egress control structure for separating two areas and regulating the passage of human traffic between the two areas such as might be utilized in, for example, a mass transportation system, a theater or amusement park, etc.

Increasing labor costs have resulted in increased automation on many levels. The control of human traffic between two areas where the passage from one to the other requires that some value be exchanged for the passage is no exception. For example, the assignee of the present application has in recent years instituted a highly automated "ticket-taking system" in connection with its commuter rail service in the Chicago, Illinois, U.S.A. metropolitan area. In this system, many ticket sellers have been replaced with automated ticket vending apparatus and human ticket takers have been replaced with ticket operated turnstiles at the various stations. Typically, a commuter, having obtained a coded ticket, will enter a boarding area via a turnstile into which the ticket is placed. The ticket is processed by a value receiving device associated with the turnstile and returned to the commuter who will then board the train until his desired destination is reached.

At that time, the commuter will leave the train and exit the boarding area at his destination, again through a turnstile. The ticket is again placed within the turnstile and if a processing of the ticket by turnstile associated apparatus indicates that the ticket was issued for value for a trip between the two points actually traveled by the commuter, the turnstile will allow the commuter to exit there through.

Conversely, should the ticket have been issued for a shorter ride than that acutally taken by the commuter, the turnstile will not operate and the commuter may seek manual assistance from a remote control center for all stations via a phone or the like.

Video and aural monitoring of each such location is continuously made at a remote, central control station so that assistance may be readily rendered when necessary.

The system has worked extremely well for its intended purpose. By reason of the monitoring of each location, assistance is readily available to those who require it from but a very small number of persons at a remote control center serving all stations. Yet the labor costs associated with ticket takers and ticket sellers at each of the stations has been eliminated.

In one area, the system is not without flaws. In particular, handicapped persons in wheel chairs, for example, may find it impossible to move through the turnstile, with or without extensive manual assistance and as a consequence, are effectively denied use of the transportation system. Similarly, ambulatory persons requiring assistance may move through the turnstiles only with considerable difficulty. For example, an elderly person, or one requiring the use of crutches may find the turnstiles almost impossible to negotiate.

Similar difficulties attend the use of automated admissions or egress control structures separating two areas and regulating the passage of human traffic therethrough such as may be used at theaters, amusement parks or the like.

SUMMARY OF THE INVENTION

The present invention is directed to overcoming one or more of the above problems.

According to the present invention, there is provided an admission and/or egress control structure for separating two areas and regulating the passage of human traffic between the two areas. The control structure includes a barrier adapted to be disposed between the two areas to be separated and at least one turnstile is located in the barrier through which unassisted, ambulatory humans may easily pass from one area to the other. At least one gate is disposed in the barrier and extends to the bottom thereof through which non-ambulatory and assisted ambulatory humans may easily pass from one area to the other. Means mount the gate for movement between open and closed positions relative to the barrier and means normally and yieldably urge the gate towards the closed position. Means are provided for normally locking the gate in the closed position. Means are also provided for operating the locking means to unlock the gate from the closed position whereby non-ambulatory and assisted ambulatory humans may move the gate against the urging means to the open position to pass easily therethrough to move from one area to the other without traversing either the barrier or the turnstile.

According to preferred embodiment of the invention, the gate is mounted on one side for pivotal movement about a generally vertical axis so as to swing to either side of the barrier. The locking means includes a latch moveably mounted within the barrier for engagement with the gate on the side thereof opposite the one side.

On a highly preferred embodiment, there is provided a motor energizable to move the latch element to a position positively locking the gate in the closed position along with unpowered means for moving the latch element to a position unlocking the gate whenever the motor is deenergized. Consequently, the gate will be unlocked in the event of a power failure.

According to another aspect of the invention, there is provided a gate especially adapted for controlling non-ambulatory and assisted ambulatory human traffic in passing between two areas. The gate includes first and second spaced uprights, the space between the uprights defining a traffic zone. A gate panel substantially spans the space between the uprights and has opposed edges, one in proximity to each upright. Hinge means interconnect the first upright and the gate for pivotally mounting the gate for swinging movement about a generally vertical axis adjacent to one of the panel edges and towards either side of the traffic zone. Spring means resiliently urge the gate towards a position aligned with the uprights and blocking the traffic zone. An apertured lock plate is mounted on one of the second upright and the other of the panel edges and a lock is mounted on the other of the second upright and the other of the panel edges. The lock includes a moveably mounted bolt receivable in the lock plate, a spring urging the bolt away from the lock plate, and a selectively energizable motor for moving the bolt into the lock plate.

Other objects and advantages become apparent from the following specification taken in connection with the accompanying drawings.

DESCRIPTION OF THE DRAWINGS

FIG. 1 is a perspective view of an admission and/or egress control structure separating two areas between which human traffic may pass and made according to the invention;

FIG. 2 is a somewhat schematic, side elevation of the control structure and part of a remote monitoring station;

FIG. 3 is a perspective view of a gate made according to the invention;

FIG. 4 is a fragmentary, perspective view of one side of the gate with parts removed for clarity;

FIG. 5 is a perspective view of a locking mechanism made according to the invention and its location within part of the barrier structure;

FIG. 6 is an enlarged view of the locking mechanism;

DESCRIPTION OF THE PREFERRED EMBODIMENT

Figure 7:
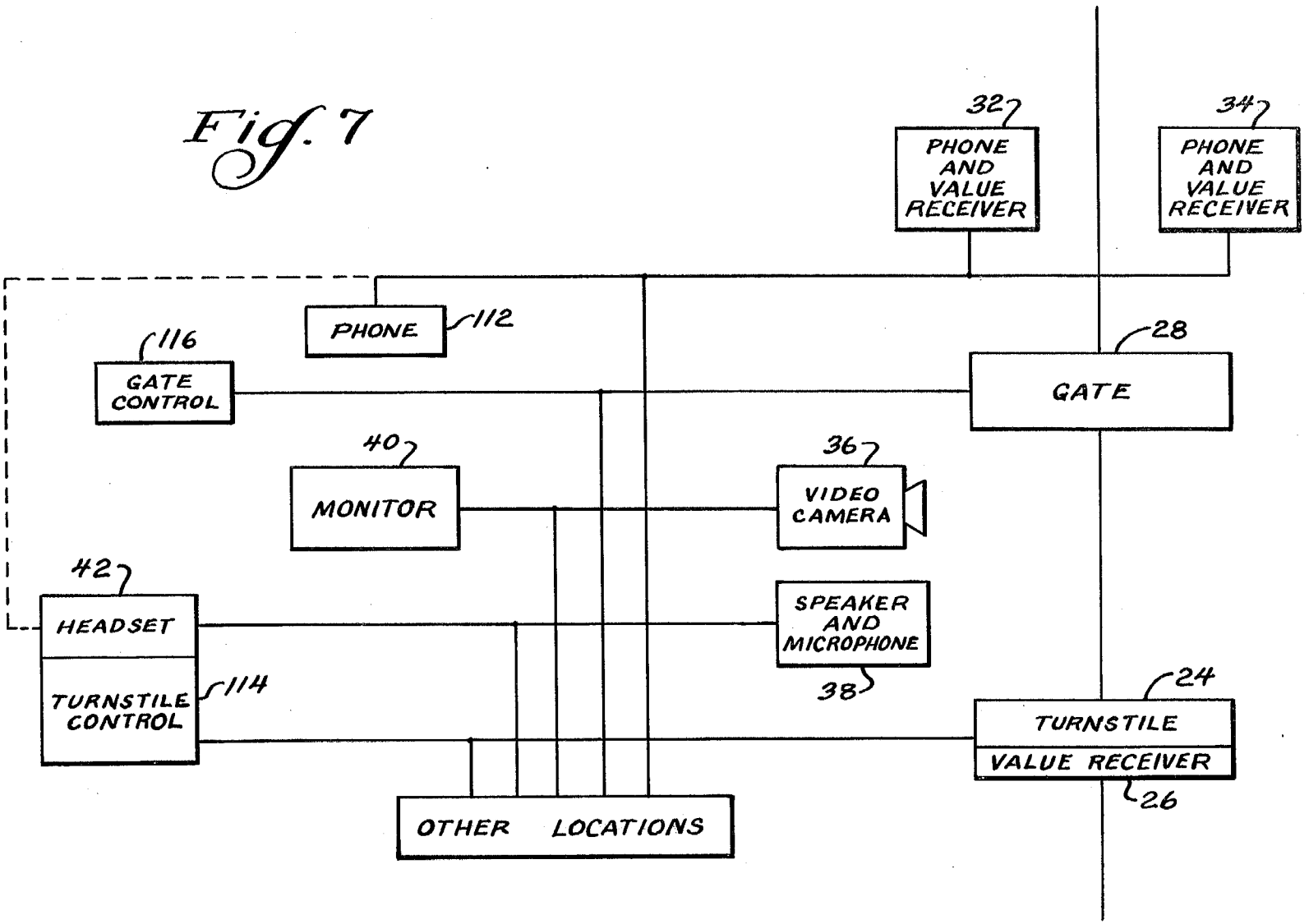
FIG. 7 is a block diagram of system employing the invention.

An exemplary embodiment of the invention is illustrated in FIG. 1 in the environment of a commuter station. In the foreground, is an area 10 which may be, for example, the entrance to or exit from the station. A barrier, generally designated 12, separates the area 10 from an area 14. The area 14 includes stairs 16 which may lead to, for example, a boarding area. To facilitate movement of the handicapped, the stairs 16 are paralleled by ramps 18 which also lead to the boarding area.

The barrier 12 extends between side walls 20 and 22 so that all passage of human traffic between the areas 10 and 14 must be through the barrier 12. To provide for such traffic passage, the barrier 12 includes a plurality of conventional turnstiles 24 which, as will be recognized, easily allow unassisted human traffic to pass therethrough. Automated ticket processing apparatus is associated with each turnstile and is schematically shown at 26 in FIG. 1. The manner in which such operates forms no part of the present invention.

A gate structure 28 is also disposed in the barrier 12 and will be described in greater detail hereinafter. Preferably, the gate structure 28 is such as to expose an opening of sufficient width that a wheelchair may easily pass therethrough. Typically, the width will be on the order of 36 inches and in order to facilitate passage of a wheelchair of the like, the opening in which the gate 28 is disposed extends down to the floor, i.e., to the bottom of the barrier 12.

To the left of the gate 28 is a part 30 of the barrier 12. On either side of the part 30, there are disposed two conventional pay-type telephones 32 and 34. Telephones provide a means whereby a person in either of the areas 10 and 14 can seek assistance from a remote control center. The phones are wired so that coins need not be placed in the pay phones in order to establish communications with the remote control center. However, the coin receiving means on each of the phones 32 and 34 is utilized as a value receiving means to provide signals to the remote control center, in a conventional fashion, that a given amount of money has been deposited therein.

In the usual case, unassisted, ambulatory humans will purchase via automated ticket issuing machines (not shown) or receive them by other means, as for example, via the mail. In the case of a handicapped person, or an ambulatory person on crutches, a ticket issuing machine may be difficult to operate with the consequence that the fare is deposited in the money taking part of either of the phones 32 and 34.

It is to be noted that the phones 32 and 34 are disposed adjacent to fixed part 30 of the barrier 12. Thus, a person using either one of the phones 32 ad 34 will be out of the normal flow of traffic through the turnstile 24 or the gate 28 so as not to disrupt the traffic pattern.

FIG. 2 illustrates additional structure of a system in which the invention is advantageously employed including a video camera such as a TV camera 36 which is trained on the barrier structure 12. Also included is a combination microphone and speaker unit 38 by which a person at a remote control center may issue instructions to a person in either of the areas 10 or 14 or receive requests for information or responses to directions from such a person without use of either of the phones 32 and 34.

At a remote location, there is provided a video monitor in the form of a television monitor 40 along with a headset 42, for example, which are connected to the camera 36 and speaker system 38 respectively enabling an operator in the remote control center to monitor, both visually and aurally the happenings in the vicinity of the barrier 12.

In the usual case, one operator at the remote control center will monitor several such locations, there typically being provided an electronic scan system of known type to periodically switch from one station to another with a provision for interupting the scan from its normal sequence when assistance is required or an unusual happening observed.

FIG. 3 illustrates a preferred form of gate. The same includes a pair of spaced uprights 50 and 52 forming part of the barrier 12. The gate 28 is in the form of a rectangular panel and one edge 54 thereof is connected by hinges 56 to the upright 50 so that the gate 28 may swing to either side of the barrier 12 about a generally vertical axis. To facilitate opening of the gate 28 in either such direction, the hinges 56 are so called double acting hinges of conventional construction. They additionally include conventional spring mechanisms whereby the gate 28 is always urged, albeit yieldably, to its closed position as illustrated in FIG. 3.

FIG. 4 illustrates the gate 28 with covering panels removed. The same may be formed of interconnected channels 58 and strengthened by cross members 60.

The edge 62 is provided with a lock plate 64 having a central aperture 66 for receipt of a lock bolt. When the gate is formed of a non-ferrous material as, for example, aluminum, for purposes to be seen, the edge 62 may also carry a piece of magnetic material 68.

It can be appreciated that the upright 52 is in the form of a housing as seen in both FIG. 1 and 3, and the wall of the same facing the edge 62 is formed as illustrated in FIG. 5. A frame structure is made as illustrated and includes frame members 70 which are covered by one or more panels 72. A permanent magnet 74 is carried by the upright 52 in vertical alignment with the magnetic material 68 and is adapted to exert an attracting force on the magnetic material 68 to center the gate 28 in the closed position illustrated in FIG. 3.

Within the upright 52 there is also mounted a lock mechanism generally designated 76. The lock mechanism includes a T-shaped base 78, the top of which is secured to one of the panels 72 and the bottom of which extends into the upright 52. As seen in FIG. 6, a U-shaped bracket 80 secured to the base 78 reciprocally mounts a lockbolt 82 for reciprocal movement through an opening 84 in one of the panels 72. The emerging end 86 of the lockbolt 82 is beveled as illustrated so as to easily enter the aperture 66 in the lock plate 64 in spite of slight misalignment between the two. When the lock-bolt 82 is extended from the upright 52 into the aperture 66, the gate 28 will be positively locked in the closed position.

A lever 88 has its upper end pivoted by a bolt 90 to the base 78. Intermediate its ends, the lever 88 includes an elongated slot 92 in which is received a pin 94 carried by the bolt 82.

The lower end of the lever 86 includes a pivot pin 96 which is pivotly connected to the armature 98 of a solenoid 100 mounted on the base 78. A spring 102 has one end connected to the pivot pin 96 and its opposite end connected to a stud 104 on the base 78.

The solenoid 100 is of the type that, when energized, will draw its armature 98 into its coil 106 to the solid line position illustrated in FIG. 6. The same may or may not include an internal spring return but in any event, the spring 102 serves to bias the lever 88 toward the dotted line position shown in FIG. 6. As can be appreciated, by reason of the connection between the pin 94 and the slot 92, the bolt 82 will be extended to a locking position whenever the solenoid 100 is energized and will be retracted from a locking position to an unlocking position by reason of the spring 102 whenever the solenoid 100 is not energized.

This is a preferred form of the lock in that in the event of a power failure, the spring 102 will pull the bolt 82 to the unlock position to allow the gate 28 to be opened.

The base 78 also includes an elongated slot 108 extending generally in the direction of the elongation of the bolt 82 which adjustably receives a stop 110 which limits movement of the lever 88 in the unlocking direction.

Use of the system will now be explained in connection with the foregoing and with reference to FIG. 7 in addition to the previously described figures. In the usual case, the unassisted ambulatory human passing through the barrier 12 will deposit a thing of value, such as a ticket, in a value receiver 26 associated with a given one of the turnstiles 24 and pass therethrough in the usual fashion. Should a difficulty occur, and the same not be visually observed on the camera 36, the person may go to either the phone 32 or the phone 34, depending upon whether the human is in the area of 10 or 14 and call for assistance. The phones 32 and 34 are connected to a phone 112 in the remote control center in close proximity to the monitor 40 so that a person observing the monitor 40 may communicate with the human requiring assistance. Optionally, the phone 112 can be dispensed with and the phones 32 and 34 connected to the headset 42.

The person operating the remote control center may, if the situation requires, manually operate a turnstile control, 114 allowing the person requiring assistance to pass through the turnstile without the turnstile having received a proper indication from its internal value receiver 26.

In the event a handicapped person, or an ambulatory person assisted by another human or by mechanical means, such as crutches, desires to pass through the barrier 12, that person may call on either of the phones 32 or 34 to the remote control center for assistance. In this connection, it is preferable that the phones 32 and 34 be placed on the wall 20 at a sufficiently low level so as to be easily accessible by, for example, a person sitting in a wheel chair. Once communication with the remote control center is established, the person operating the remote control center may instruct the non-ambulatory person to deposit money in the corresponding phone in an amount sufficient to cover the anticipated trip or admission price, as the case may be. Either the phone 32 or 34 will provide the usual signal back to the remote control center by which the depositing of the appropriate amount of money can be determined. Once this has occurred, a gate control 116 at the remote control center can be operated to interupt all power to the solenoid 100 whereupon the spring 102 (FIG. 6) will ulimately cause the bolt 82 to move to an unlatched position. The person may then be directed, either by the phone 32 or 34 or the spekaer system 38 to pass through the gate 28. Once that person has passed through the gate, the internal spring mechanism associated with the hinges will return the gate 28 to the closed position at which time power may be restored to the solenoid 100 to lock the gate in its closed position. The completion of passage of such a person through the gate 28 may be monitored on the monitor 40.

Alternately, the approach of a handicapped person or assisted ambulatory position toward the barrier 12 may be observed on the monitor 40 during the usual scan of the various stations. In such a case, the operator at the remote control station may direct, through use of the speaker system 38, the person to either the phone 32 or 34 as the case may be with instructions to deposit whatever money is required for passage. The remainder of the procedure may then take place as mentioned immediately preceding.

It is to be observed that the invention, in its most preferred sense, utilizes the means such as the phones 32 and 34 as value receivers which may be manually monitored to control the gate 28. If automatic value receivers such as those 26 associated with the turnstile 24 were employed, it is possible that through the use of one ticket or the like, the gate 28 could be opened and held open to allow an unlimited number of humans to pass therethrough. This could be overcome through the use of an automatic closure for the gate 28 but this too is undesirable in that there is no assurance that a handicapped person would fully pass therethrough before the automatic closure 28 would begin to return the gate 28 to its closed position. Moreover, such a system could require special means to disable the automatic closure in the event of a power failure whereas the present invention does not.

From the foregoing, it will be appreciated that an admission and/or egress control structure made according to the invention maintains the labor savings associated with automated control strucutres of this type and further enables all human traffic, whether non-ambulatory, assisted ambulatory, or unassisted ambulatory to easily use the same.

The embodiments of the invention in which an exclusive property or privilege is claimed are defined as follows:

1. An admission and/or egress control structure for separating two areas and regulating the passage of human traffic between the two areas comprising;

a barrier adapted to be disposed between the two areas to be separated;

at least one turnstile in said barrier thru which unassisted, ambulatory humans may easily pass from one area to the other;

at least one gate in said barrier extending to the bottom thereof thru which non ambulatory and assisted ambulatory humans may easily pass from one area to the other;

means mounting said gate for movement between open and closed positions relative to said barrier;

means normally and yieldably urging said gate toward said closed position;

means normally locking said gate in said closed position; and means for operating said locking means to unlock said gate from said closed position whereby non ambulatory and assisted ambulatory humans may move said gate against said urging means to said open position to pass easily therethrough to move from one area to the other without traversing either said barrier or said turnstile.

2. The admission and/or egress control structure of claim 1 wherein said mounting means mounts said gate on one side thereof for pivotal movement about a generally vertical axis for swinging movement to both sides of said barrier and said locking means includes a latch movably mounted within said barrier for engagement with said gate on the side thereof opposite said one side.

3. The admission and/or egress control structure of claim 1 wherein said locking means comprises a movable latch element for positively locking said gate in said closed position, a motor energizeable to move said latch element to a position positively locking said gate in said closed position, and unpowered means for moving said latch element to a position unlocking said gate whenever said motor is de-energized whereby said gate will be unlocked in the event of a failure of a power source for said motor.

4. A gate especially adapted for controlling non ambulatory and assisted ambulatory human traffic in passing between two areas comprising:

first and second spaced uprights; the space between said uprights defining a traffic zone;

a gate panel substantially spanning the space between said uprights and having opposed edges, one in proximity to each upright;

hinge means interconnecting said gate for pivotally mounting said gate for swinging movement about a generally vertical axis adjacent one of said panel edges and towards either side of said traffic zone;

spring means resiliently urging said gate towards a position aligned with said uprights and blocking said traffic zone;

an apertured lock plate mounted on one of the second upright and the other of said panel edges; and a lock mounted on the other of the second upright and the other of said panel edges, said lock including a moveable mounted bolt receivable in said lock plate, a spring urging said bolt away from said lock plate, and a selectively energizable motor for moving said bolt into said lock plate.

5. The gate of claim 4 wherein said lock plate is mounted on said gate other edge and said lock is mounted on said second upright; said second upright comprising a housing substantially entirely enclosing said lock.

6. The gate of claim 4 wherein said lock includes a base, a lever, a pivot mounting said lever on said base, a guide mounted on said base and reciprocally mounting said bolt, means connecting said bolt to said lever at a location remote from said pivot means mounting said spring on said base; and means connecting said spring to said lever at a location remote from said pivot, said motor comprising a solenoid mounted on said base and having its armature connected to said lever at a location remote from said pivot.

7. The gate of claim 6 wherein said means connecting said bolt to said lever comprises a pin and slot connection.

8. The gate of claim 4 further including means for aligning said gate and said second upright so that said lock plate and said bolt are aligned.

9. The gate of claim 8 wherein said aligning means comprises a magnet and magnetic material, one on said second upright and the other on said panel other edge.

10. An admission and/or egress control structure for separating two areas and regulating the passage of human traffic between the two areas comprising;

a barrier adapted to be disposed between the two areas to be separated;

two openings in said barrier extending from top to bottom thereof, one being narrower than the other;

a turnstile disposed in the narrower one of said openings to prevent unregulated passage of human traffic therethrough;

a gate in the wider of said openings and movable between positions substantially totally unblocking said wider opening and blocking said wider opening to prevent unregulated passage of human traffic therethrough;

means for returning said gate to said blocking position from said unblocking position;

means normally locking said gate in said blocking position;

means for disabling said locking means;

first vlaue receiving means connected to said turnstile for enabling said turnstile to pass human traffic in response to receipt of some measure of value; and second value receiving means in close proximity to said gate for issuing a signal in response to receipt of some measure of value whereby said disabling means may be operated to enable said gate to be moved to its unblocking position to pass human traffic.

11. The admission and/or egress control structure of claim 10 further including a video camera trained on said barrier and a remote video monitor connected to said camera, said disabling means including a manually operated remote control in proximity to said monitor, and means in proximity to said monitor for receiving said signal from said second value receiving means and indicating that said signal has been received.

* * * * *